US008733023B2

(12) United States Patent
Rahardjo et al.

(10) Patent No.: US 8,733,023 B2
(45) Date of Patent: May 27, 2014

(54) DOOR ARRANGEMENT AND GUIDE OF A DOOR

(75) Inventors: Andhikaputra Rahardjo, Vantaa (FI); Kari Kemppainen, Hyvinkää (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 13/405,741

(22) Filed: Feb. 27, 2012

(65) Prior Publication Data

US 2012/0151841 A1 Jun. 21, 2012

Related U.S. Application Data

(63) Continuation of application No. PCT/FI2010/000054, filed on Sep. 2, 2010.

(30) Foreign Application Priority Data

Sep. 3, 2009 (FI) ..... 20090317

(51) Int. Cl.
*E05D 13/00* (2006.01)
*E05D 15/00* (2006.01)

(52) U.S. Cl.
USPC ..... 49/411; 49/425; 16/91

(58) Field of Classification Search
USPC ..... 49/409, 410, 411, 425; 16/91, 97, 98, 16/102, 106, 107
See application file for complete search history.

(56) References Cited

U.S. PATENT DOCUMENTS

| | | | | | |
|---|---|---|---|---|---|
| 319,938 | A | * | 6/1885 | Swett | 16/91 |
| 1,274,872 | A | * | 8/1918 | Gordon | 49/372 |
| 2,650,387 | A | | 9/1953 | Foss | |
| 2,668,317 | A | | 2/1954 | LeBon | |
| 2,971,228 | A | * | 2/1961 | Szabo | 49/209 |
| 3,587,477 | A | * | 6/1971 | Ferris et al. | 105/378 |
| 3,787,936 | A | * | 1/1974 | Rystad | 24/564 |
| 4,722,150 | A | * | 2/1988 | Jacobs et al. | 49/425 |
| 4,984,332 | A | * | 1/1991 | Bienert et al. | 16/93 R |
| 5,349,783 | A | * | 9/1994 | Jasperson et al. | 49/425 |
| 5,974,738 | A | * | 11/1999 | Jacobs | 49/425 |

(Continued)

FOREIGN PATENT DOCUMENTS

| | | | | |
|---|---|---|---|---|
| EP | 532347 | A1 * | 3/1993 | E05D 13/00 |
| GB | 188228 | A | 11/1922 | |
| GB | 590763 | | 7/1947 | |
| JP | 2002308556 | A | 10/2002 | |

*Primary Examiner* — Jerry Redman
(74) *Attorney, Agent, or Firm* — Harness, Dickey & Pierce, P.L.C.

(57) ABSTRACT

Door arrangement, more particularly a sliding door arrangement of an automatic door of an elevator or of a building, which comprises a door panel, and a guide arrangement for controlling the path of movement of the door panel, which guide arrangement comprises at least one guide connected to the aforementioned door panel, and a guide rail, closely along which the aforementioned guide is arranged to move, and from which guide rail the guide takes lateral support force with respect to the longitudinal direction of the guide rail. The guide comprises a first guide roll for taking the support force from the guide surface of the guide rail on the side of a first side of the guide, and a second guide roll for taking support force from the guide surface of the guide rail on the side of a second side of the guide.

17 Claims, 2 Drawing Sheets

(56) References Cited

U.S. PATENT DOCUMENTS

Figure 1:
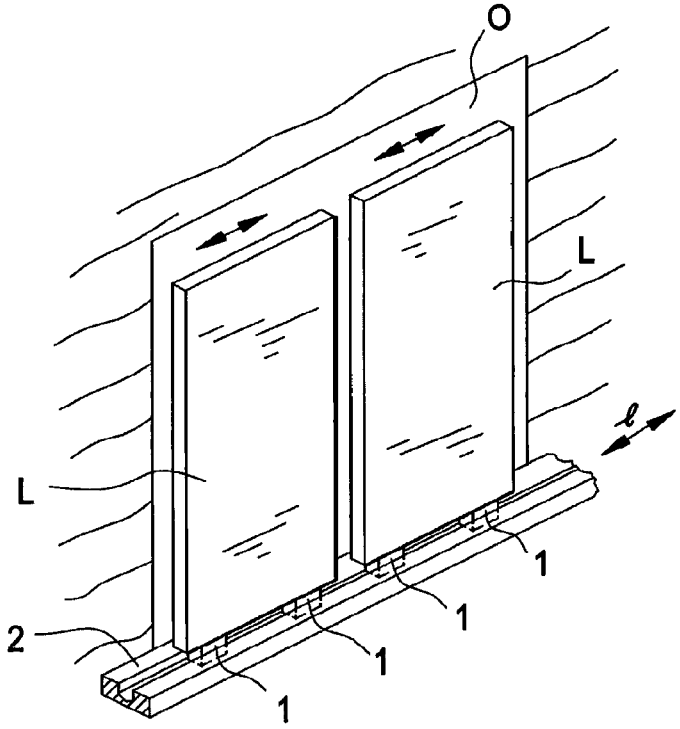

| | | | | |
|---|---|---|---|---|
| 6,449,906 | B1 * | 9/2002 | Jacobs | 49/409 |
| 7,021,007 | B2 * | 4/2006 | Jacobs | 49/425 |
| 7,644,542 | B2 * | 1/2010 | Ambrozus | 49/425 |
| 7,703,242 | B2 * | 4/2010 | Goebel et al. | 49/425 |
| 2004/0159048 | A1 | 8/2004 | Jacobs | |
| 2005/0000164 | A1 * | 1/2005 | Jacobs | 49/425 |
| 2006/0103047 | A1 * | 5/2006 | Zwolinski | 264/174.11 |
| 2010/0192468 | A1 * | 8/2010 | Chubb et al. | 49/407 |

* cited by examiner

DOOR ARRANGEMENT AND GUIDE OF A DOOR

CROSS-REFERENCE TO RELATED APPLICATIONS

This application is a continuation of International Application Number PCT/FI2010/000054 filed on Sep. 2, 2010 and claims priority to Finnish Application Number FI 20090317 filed on Sep. 3, 2009, the entire contents of each of which are hereby incorporated herein by reference.

FIELD OF THE INVENTION

The object of the invention is a door arrangement and a guide of a door.

BACKGROUND OF THE INVENTION

Roller guide shoes or sliding guides connected to a door panel are used in the prior-art sliding doors of an elevator or of automatic doors for guiding the door panel, which guide shoes or sliding guides guide closely following a guide rail by taking support force that is lateral with respect to the direction of movement of the guide from the guide rail. The guides are generally disposed on the top edge and/or on the bottom edge of the door panel. The guide rails are generally disposed in the floor of the building or corresponding or in the door header of the door opening.

The type of sliding doors with sliding guides, in which support force is taken from a guide rail with only a sliding guide that moves in a guiding groove, are known in the art. Sliding parts, however, wear quickly and a problem therefore is rapid impairment of the quality, e.g. the evenness, of the slide.

Also known in the art are the type of sliding doors with roller guide shoes, in which the roll of the guide is between two guide rail surfaces, guided by both of which the roll in question is arranged to guide the sliding door supported on the guide rail surface of that side, to which the roll is closest at the time. This type of solution is presented in, among others, publication JP2002308556A. One problem with these types of solutions is the continuously repeated change of rotation direction of the roll, which change always occurs when the roll swings in the lateral direction from the guidance of a first guide rail surface to a second. This increases the wearing of the surface and bearing of the roll and at its worst might cause noise. It is advantageous to dimension the roll to travel close to both guide rail surfaces. A problem in this case is also that, e.g. as a result of becoming dirty, the roll is not necessarily able to rotate freely and starts to slide against the surfaces of the guide rail, thus being in contact with the surface of two guides at the same time, which might increase the wearing.

A problem in all these solutions is that as the primary guide element (roll or sliding shoe) of a guide wears, its dimensions change so that the clearances of the guide increase to be such that the sliding door no longer travels evenly and might produce noise. After the occurrence of this wearing problem, the sliding guide part must be replaced very quickly, because the sliding guide quickly loses its usability completely.

OBJECT OF THE INVENTION

The object of the invention is to eliminate, among others, the aforementioned drawbacks of prior-art solutions. More particularly the purpose of the invention is to produce a door arrangement and a guide of the door that are improved in terms of their wear behavior. The purpose of the invention is further to produce one or more of the following advantages, among others:

- A better door arrangement and guide, in terms of their susceptibility to malfunction (e.g. jamming or wearing) are achieved.
- A door arrangement and guide are achieved that retain their usability at a tolerable level despite the wearing of their primary guide element. Thus the replacement interval of the wearing parts of a sliding guide can be lengthened.
- A door arrangement and guide are achieved wherein the wearing of their guide element/guide elements slows down as the wear progresses. Thus replacement of the guide element does not have to be performed promptly in haste after detecting the wear, but instead the replacement can be performed e.g. at a time of low usage.

SUMMARY OF THE INVENTION

The door arrangement includes a guide having a first guide roll supported by a guide surface of the guide rail on a first side of the at least one guide, and a second guide roll supported by the guide surface of the guide rail on a second side of the at least one guide. The guide of a door includes a first guide roll configured to be supported by a guide rail surface on a first side of the guide; and a second guide roll configured to be supported by a guide rail surface on a second side of the guide. Other embodiments of the invention can be defined to be characterized by what is disclosed in the other claims. Some inventive embodiments are also presented in the descriptive section and in the drawings of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. The features of the various embodiments can be applied within the framework of the basic inventive concept in conjunction with other embodiments. The additional procedures/additional features of the invention defined in the non-independent claims could also be regarded separately from the procedures of an independent claim as separate inventions in their own right.

The door arrangement according to the invention, more particularly a sliding door arrangement of an automatic door of an elevator or of a building, comprises a door panel, and a guide arrangement for controlling the path of movement of the door panel, which guide arrangement comprises at least one guide (1) connected to the aforementioned door panel, and a guide rail, closely along which the aforementioned guide is arranged to move, and from which guide rail the guide takes lateral support force with respect to the longitudinal direction of the guide rail. The guide comprises a first guide roll for taking support force from the guide rail surface on the side of a first side of the guide, and a second guide roll for taking support force from the guide rail surface on the side of a second side of the guide.

In one embodiment of the invention the first and the second guide roll are freely rotatable around a vertical center of rotation.

In one embodiment of the invention the centers of rotation of the first and the second guide roll are at different points in the longitudinal direction of the guide rail.

In one embodiment of the invention each of the aforementioned guide rolls is able to make contact with the guide rail surface on only one side of the guide. In one embodiment of the invention the first and the second guide roll possess diameters of the same magnitude and their centers of rotation are at a distance from each other in the lateral direction of the guide rail (and thus also of the guide). Thus preferably it can be implemented such that each of the aforementioned guide rolls is able to make contact with the guide rail surface on only one side of the guide.

In one embodiment of the invention the first and the second guide roll are overlapping in the longitudinal direction of the guide rail.

In one embodiment of the invention the vertical supporting of the door panel is in the top part of the door panel and the bottom side is supported only in the lateral direction. This can be performed by means of the aforementioned guide rail, from which the aforementioned at least one guide can take lateral support force. In this way it does not need to rest on the base of the groove, into which possible dirt sinks. Thus the jamming of an automatically movable door can be reduced and the need for repair decreased and the availability of the elevator or of the building remains good.

In one embodiment of the invention the guide additionally comprises a sliding guide surface for taking support force from the guide rail surface on the side of a first side of the guide, and a sliding guide surface for taking support force from the guide rail surface on the side of a second side of the guide. One advantage is that when the roller guide shoe wears, the sliding guide parts can ensure guidance of at least a certain quality.

In one embodiment of the invention the guide comprises (in the longitudinal direction of the guide rail) a sliding guide surface of a sliding guide part in front of and/or behind each guide roll. In this way the guide is not sensitive to rotation and keeps its line. In this way the guide is particularly suited to travel in a straight guide rail.

In one embodiment of the invention the guide comprises (in the longitudinal direction of the guide rail) a sliding guide surface (in the longitudinal direction of the guide rail) of a sliding guide part in front of and/or behind each guide roll at a distance from the aforementioned guide roll. In this way the guide is not sensitive to rotation and keeps its line. In this way the guide is particularly suited to travel in a straight guide rail.

In one embodiment of the invention the guide rail is a guide rail that comprises a straight groove, preferably an essentially U-shaped rail, in which the groove formed by the U-profile is open upwards.

In one embodiment of the invention the guide comprises a guide frame, on which the aforementioned first and second guide roll are supported.

In one embodiment of the invention the guide comprises a guide frame, on which two guide rolls that are rotating in relation to the guide frame are rigidly supported.

In one embodiment of the invention each guide roll is supported on the guide frame with a bolt that extends through the roller guide shoe from above, which bolt forms the axis of rotation of the guide roll, which bolt preferably fixes rigidly to the guide frame, e.g. by means of a nut resting on the guide frame.

In one embodiment of the invention the guide frame is rigidly supported on the door panel.

In one embodiment of the invention the guide arrangement comprises two aforementioned guides that are at a distance from each other.

In one embodiment of the invention the guide rail comprises a groove, which comprises two side surfaces, which side surfaces each form a guide surface at least for a guide roll of the guide, preferably also for a sliding guide surface.

In one embodiment of the invention the guide surface of the roller guide shoe extends in the vertical direction to above and to below the sliding guide surface.

In one embodiment of the invention the wearing of the sliding guide part as measured in the lateral direction is arranged to gradually slow down as the wear progresses. For example, as a consequence of wear the sliding guide part starts to bear the load on an increasingly enlarging surface area, which gradually slows down the wearing.

In one embodiment of the invention the surface area of the sliding guide surface that comes into contact with the guide rail surface expands as the sliding guide part wears. The sliding guide part can in this case be of such a shape that e.g. its cross-sectional surface decreases towards the lateral direction.

In one embodiment of the invention the sliding guide part comprising a sliding guide surface is, in terms of its shape, narrowing towards the guide surface of the guide rail.

In one embodiment of the invention the sliding guide part comprising the aforementioned sliding guide surface is an integral part of the guide frame. One advantage is an inexpensive and simple structure.

In one embodiment of the invention the guide comprises two sliding guide surfaces facing a first lateral direction and two sliding guide surfaces facing a second lateral direction, and all of which sliding guide surfaces are preferably an integral part of the guide frame.

In one embodiment of the invention the material of the guide surface of the guide roll is essentially harder than the material of the sliding guide part and/or of the guide frame, preferably such that the material of the sliding guide part and/or of the guide frame is high-density polyethylene (HDPE) and the material of the guide surface of the guide roll is ultra-high-density polyethylene (UHDPE). The guide thus withstands impacts but the roller guide shoes that perform the primary guide function are not susceptible to wear.

In one embodiment of the invention the material of the sliding guide surface is HDPE.

In one embodiment of the invention the friction factor of the material of the guide surface of the roller guide shoe is essentially lower than the friction factor of the material of the sliding guide surface, preferably such that the material of the sliding guide surface is HDPE and the material of the guide surface of the roller guide shoe is UHDPE. The roller guide shoes that perform the primary guidance function are therefore not as susceptible to wear and last for a long time, whereas the secondary guide elements can be manufactured more cheaply because neither a long service life nor first-class quality is required of them.

In one embodiment of the invention the guide is arranged to take support force from the guide rail in at least one lateral direction such that at least the main part of the support force is arranged to be transmitted to the guide via the guide roll, and that when the guide roll wears the proportion of the support force taken by the guide via the sliding guide surface(s) from the total support force of the guide in the lateral direction in question is arranged to increase as a consequence of the wearing of the guide roll (preferably gradually). This can form a separate invention regardless of the attributes presented in the characterization part and is advantageous to combine in connection with the preceding and aforementioned embodiments, or with the additional features or their combinations mentioned elsewhere in this application. With the embodiment an arrangement is advantageously achieved wherein, despite a need to replace the guide roll, the guidance still functions for a while at a tolerable quality, the weakening of which quality slows down as the wear progresses.

In one embodiment of the invention the sliding guide surface(s) is/are arranged to be able to move into contact with the guide surface of the guide rail only after the guide roll has worn by a certain amount. In one embodiment of the invention the greatest distance between the outer rims of the first and the second guide roll in the lateral direction of the guide rail is greater than the greatest distance between the sliding guide surfaces (4,4";4',4'") in the lateral direction of the guide rail. Thus it can be simply implemented that the sliding guide surface(s) is/are able to move into contact with the guide surface of the guide rail only after the guide roll has worn by a certain amount. On the other hand, one advantage is that before there is abundant wear, the sliding guide surfaces prevent rotation of the guide.

In one embodiment of the invention the parts are placed such that when the guide surface of the guide roll is in contact with the guide surface of the guide rail, the sliding guide surface is separated from the guide surface of the guide rail. This is particularly advantageous in the case of a new guide that has just been commissioned.

According to the invention the guide comprises a first guide roll for taking support force from the guide rail surface on the side of a first side of the guide, and a second guide roll for taking support force from the guide rail surface on the side of a second side of the guide.

In one embodiment of the invention the guide comprises a guide frame, on which the aforementioned two guide rolls that are rotating in relation to the guide frame are rigidly supported.

In one embodiment of the invention the guide comprises two sliding guide surfaces facing a first lateral direction and two sliding guide surfaces facing a second lateral direction, and all of which sliding guide surfaces are preferably an integral part of the guide frame.

In one embodiment of the invention the guide comprises a sliding guide surface of a sliding guide part in front of and/or behind each guide roll.

In one embodiment of the invention the guide comprises a guide frame, on which the aforementioned first and second guide roll are supported.

In one embodiment of the invention the centers of rotation of the first and the second guide roll are at different points in the longitudinal direction of the guide rail.

In one embodiment of the invention each of the aforementioned guide rolls is able to make contact with the guide rail surface on only one side of the guide.

In one embodiment of the invention the first and the second guide roll are overlapping in the longitudinal direction of the guide rail.

The features of other embodiments of the sliding guide according to the invention are presented elsewhere in this application, e.g. the additional features mentioned in connection with door arrangement applications.

LIST OF FIGURES

In the following, the invention will be described in detail by the aid of some examples of its embodiments with reference to the attached drawings, wherein FIG. 1 presents an indicative three-dimensional view of a door arrangement according to the invention.

Figure 2A:
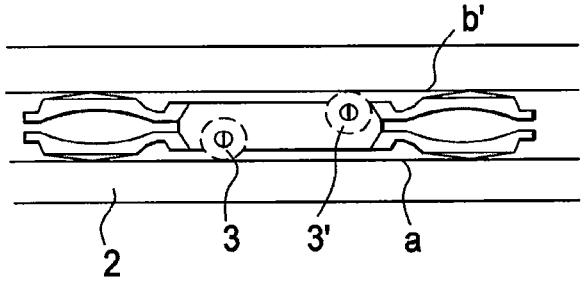

FIG. 2*a* presents the placement of the guide of a door arrangement according to the invention in the guide rail, as viewed from above.

Figure 2B:
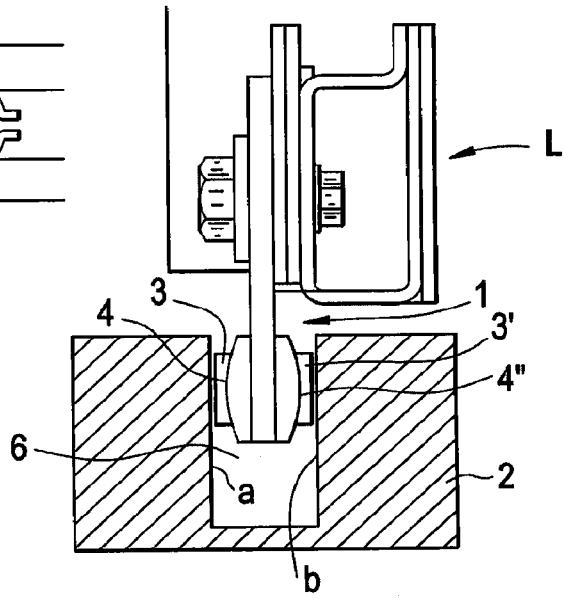

FIG. 2*b* presents a guide arrangement of a door arrangement according to the invention, as viewed in the longitudinal direction of the guide rail.

Figure 3:
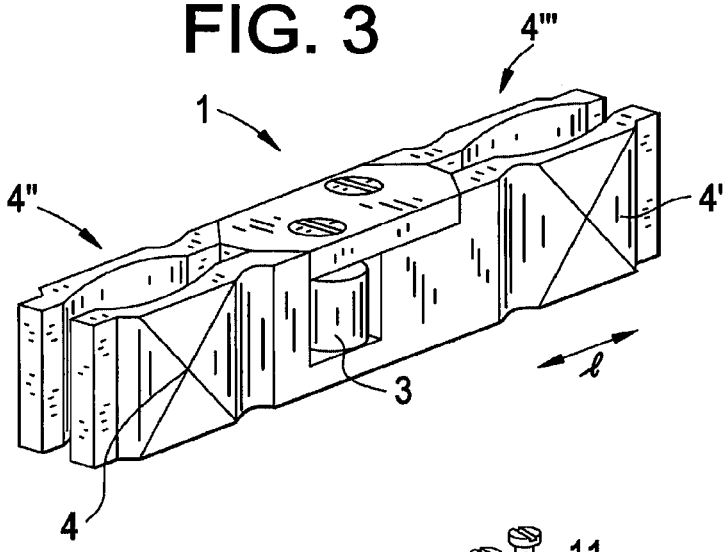

FIG. 3 presents a guide to be used in a door arrangement according to the invention, as viewed obliquely from a first side.

Figure 4:
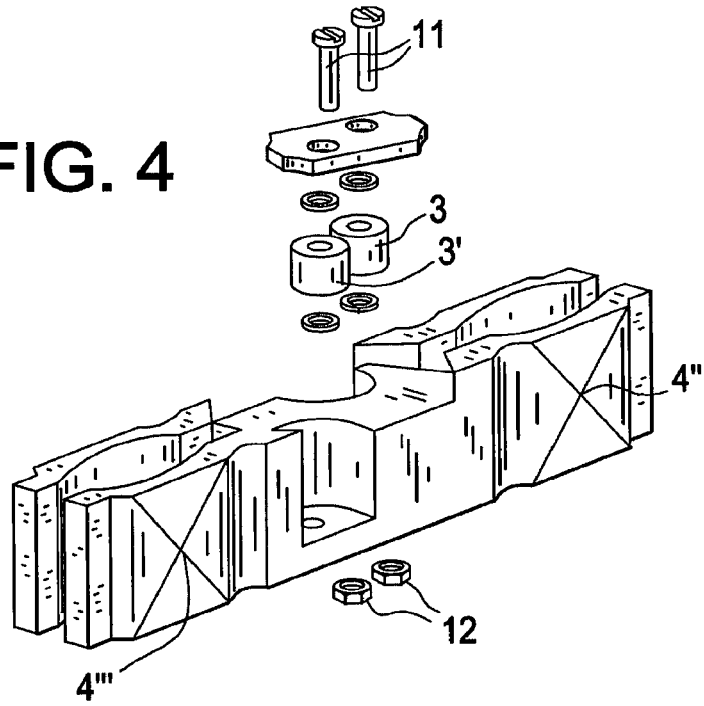

FIG. 4 presents an explosion drawing of a guide according to FIG. 3, as viewed obliquely from a second side.

Figure 5:
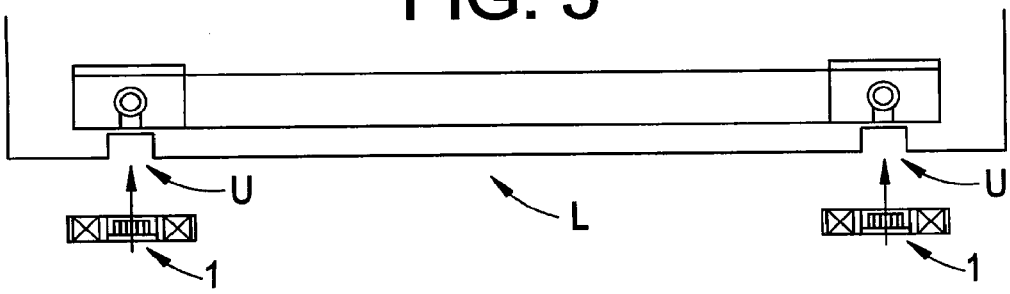

FIG. 5 presents a preferred fixing of a guide of a door arrangement according to the invention into a door panel.

DETAILED DESCRIPTION OF THE INVENTION

FIG. 1 presents an indicative three-dimensional view of a door arrangement according to the invention. In the arrangement the door panel L is arranged to move on a path of movement controlled by the guide arrangement in front of the access opening O between a position that covers the access opening and a position that covers the access opening less. The access opening O can be the door opening of an elevator car, the opening of a landing door of an elevator, or some other access opening of the building, e.g. an entrance to a building or to a part of a building. The door panel preferably receives its operating power from an actuator (not shown), such as e.g. an electric motor or a linear motor.

The guide arrangement for controlling the path of movement of a door panel L comprises two guides 1 rigidly supported on the door panel that are at a distance from each other and disposed on the bottom edge of the door panel, and a guide rail 2, closely along which the aforementioned guide is arranged to move, and from which guide rail 2 the guide 1 takes lateral support force with respect to the longitudinal direction of the guide rail. The vertical supporting, and preferably also the power transmission, of the door is in the top part of the door panel and the bottom side is supported only in the lateral direction by means of the aforementioned guide rail.

The construction of the guide 1 is presented in more detail in FIGS. 2-4. The guide comprises a first guide roll for taking support force from the guide rail surface on the side of a first side of the guide, and a second guide roll for taking support force from the guide rail surface on the side of a second side of the guide. Each of the aforementioned guide rolls is able to make contact with the guide surface a,b of the guide rail on only one side of the guide, so that the direction of rotation of the guide roll does not vary as the door proceeds in one direction because the guide roll is not able to change the contact surface. Also, tangential forces that cancel each other out are not exerted on the guide roll in a jamming situation either, which could be the situation if the guide roll were, e.g. because of becoming dirty, in contact with the guide surfaces a,b on both sides. The first and the second guide roll are freely rotatable around the vertical center of rotation. The centers of rotation of the first and the second guide roll are at different points in the longitudinal direction of the guide rail, an advantage of which is a narrow structure in the lateral direction. More precisely, the first and the second guide roll are overlapping (partly side-by-side) in the longitudinal direction of the guide rail. Thus the guide is also compact in the longitudinal direction of the guide rail, which reduces e.g. the torque exerted on the frame of the guide.

The guide additionally comprises a sliding guide surface (4,4') of the sliding guide part in front of and/or behind the guide roll 3 (in the longitudinal direction of the guide rail) for taking support force from the guide rail surface on the side of a first side of the guide, and a sliding guide surface (4",4'") of the sliding guide part in front of and/or behind the guide roll 3' for taking support force from the guide surface (b) of the guide rail on the side of a second side of the guide. One advantage is that when the roller guide shoe wears, the sliding guide part ensures at least some level of guidance.

The structure of the guide is such that the guide comprises a guide frame F, on which the aforementioned first and second guide roll 3,3' are supported, and preferably also (a) sliding guide part(s) comprising a sliding guide surface 4,4',4",4'".

The aforementioned first and second guide roll are preferably each rigidly supported on the frame F, in which case when each of the roller guide shoes wears the sliding guide surface starts to participate in the supporting only after the wear has progressed a predetermined amount. Each of the roller guide shoes is preferably supported on the guide frame with a bolt that extends through the roller guide shoe from above, which bolt forms the axis of rotation of the guide roll, which bolt preferably fixes rigidly to the guide frame, e.g. by means of a nut resting on the guide frame. The structure is in this case simple and inexpensive.

The sliding guide part comprising a sliding guide surface is, in terms of its shape, narrowing towards the guide surface of the guide rail. The surface area of the sliding guide surface that comes into contact with the guide rail surface expands as the sliding guide part wears. One advantage is that as a consequence of wear the sliding guide part starts to bear the load on an increasingly enlarging surface area, which gradually slows down the wearing. The sliding guide surface starts at the same time to bear an increasingly larger part of the lateral support load. These features lengthen the service life of the guide and prevent the sudden decline of guidance to critically bad, the worsening of the guidance quality slows down, i.e. the guidance capability of the guide declines non-linearly. The material of the guide surface (rim) of the guide roll is preferably essentially harder than the material of the sliding guide part and/or of the guide frame, preferably such that the material of the sliding guide part and/or of the guide frame is HDPE and the material of the guide surface of the guide roll is UHDPE. The guide thus withstands impacts because the softer materials can absorb the energy of an impact, but at the same time the roller guide shoes are wear-resistant. The friction factor of the material of the guide surface of the guide roll is preferably also essentially lower than the friction factor of the material of the guide surface of the sliding guide part, which is achieved e.g. such that the material of the guide surface of the sliding guide is HDPE and the material of the guide surface of the roller guide shoe is UHDPE. The guide roll is in this case more wear-resistant and withstands the performance of the guiding function longer than sliding parts. When the wear resistance of the roller guide shoe is given more emphasis than that of the sliding parts, a worn guide roll and sliding guide form a pair performing the same function, which pair comprises a part that resists wear well and a part that wears more quickly. The slide parts can be manufactured inexpensively. Thus an arrangement is advantageously achieved wherein, despite a need to replace the guide roll, the guidance still functions for a while at a tolerable quality, the weakening of which quality is slowed down after the sliding guide has entered into operation. The sliding guide part is preferably an integral part of the guide frame, in which case a separate sliding guide part is not needed and the guide is inexpensive to manufacture.

The guide is arranged to move on the guide rail G as presented in FIGS. 2*a* and 2*b*. The guide rail 2 comprises a groove G, which comprises two side surfaces a, b, which side surfaces each form a guide surface at least for the guide roll of the guide, preferably also for the sliding guide surface. The guide is arranged to take support force in lateral directions from the guide rail 2 such that at least the main part of the support force is arranged to be transmitted to the guide via the guide roll, and that when the guide roll wears the proportion of the support force taken by the guide via the sliding guide part(s) from the total support force of the guide in the lateral direction in question is arranged to increase as a consequence of the wearing of the guide roll. This is arranged in the embodiment presented in the figures such that the guide surface of the sliding guide part(s) is arranged to be able to move into contact with the guide surface of the guide rail only after the guide roll has worn by a certain amount. This is achieved because the parts are placed such that when the guide surface of the guide roll is in contact with the guide surface of the guide rail, the sliding guide surface is separated from the guide surface of the guide rail. When the sliding guide surface after the roller guide shoe has worn to the level of the sliding guide surface moves to reach contact with the guide rail surface, the sliding guide surface also starts to bear the lateral support load. In addition, or alternatively, the proportion of the support force taken by the guide via the sliding guide part can be arranged to increase as a consequence of the wearing of the roller guide shoe also, regardless of whether the sliding guide surface is in contact with the guide surface of the guide rail at the start of the commissioning of the guide or not. The proportion of the support force thus increases gradually in the solution presented also because the surface area of the sliding guide surface increases as the wear progresses. Changing the proportion of the bearing of the load can form a separate invention on its own regardless of the attributes (e.g. number of rolls) presented in the characterization part and is advantageous to combine with the additional features of the claims or with combinations of said additional features. Thus an arrangement is advantageously achieved wherein, despite a need to replace the guide roll, the guidance still functions for a while at a tolerable quality, the weakening of which quality slows down as the wear progresses, preferably gradually.

The guide surface (rim) of the guide roll extends preferably in the vertical direction to above and to below the sliding guide surface 4,4',4",4'", in which case a compact structure in the vertical direction is achieved. Another advantage is also that the sliding surface wears the guide rail in contact from the center of the guide surface of the roller guide shoe, in which case despite the wear the surface remains such that the roll does not try to bend due to the groove created.

The sliding guide surfaces of the guide 1 are preferably formed as surfaces facing the sides of the sliding guide parts, which sliding guide parts are preferably an integral part of the guide frame. The sliding guide parts can form forks that point in opposite longitudinal directions of the guide, in the manner presented in FIG. 3, in which case there is a space between the sliding guide parts that rest on the opposite sides, preferably at least a space opening upwards, in which case a part of the door panel can be placed into the space for fixing the door panel. FIG. 5 presents a preferred fixing method, in which the door panel comprises a groove U in its plate-like bottom edge, the plate-like edges of which groove U can be disposed between the sliding guide parts inside the aforementioned fork, in which case the guide 1 fixes rigidly to the door panel L.

It is obvious to the person skilled in the art that the invention is not limited to the embodiments described above, in which the invention is described using examples, but that many adaptations and different embodiments of the invention are possible within the frameworks of the inventive concept defined by the claims presented below. Thus, for example, it is obvious that the vertical supporting of the door panel could be implemented also in a different manner than what is described earlier.

The invention claimed is:

1. An elevator door arrangement comprising:

a door panel; and a guide arrangement configured to control a path of movement of the door panel, the guide arrangement including, at least one guide connected to the door panel, and a guide rail along which the at least one guide is configured to move, the guide rail being configured to laterally support the at least one guide with respect to a longitudinal direction of the guide rail, wherein the at least one guide includes, a first guide roll contacting only a first guide surface of a first side of the guide rail, a second guide roll contacting only a second guide surface of a second side of the guide rail, and a sliding guide part having a first sliding guide surface, the first sliding guide surface being configured such that a surface area of the first sliding guide surface contacting the guide rail increases as the first guide roll wears.

2. The door arrangement according to claim 1, wherein the first guide roll and the second guide roll are configured to freely rotate around a vertical center of rotation.

3. The door arrangement according to claim 1, wherein the centers of rotation of the first guide roll and the second guide roll are at different points in the longitudinal direction of the guide rail.

4. The door arrangement according to claim 1, wherein the at least one guide further comprises:

a first sliding guide surface supported by the guide surface of the first side of the guide rail, and a second sliding guide surface supported by the guide surface of the second side of the guide rail.

5. The door arrangement according to claim 1, wherein the at least one guide further comprises:

a sliding guide surface at least one of in front of and behind each of the first guide roll and the second guide roll.

6. The door arrangement according to claim 1, wherein the at least one guide further comprises:

a guide frame configured to support the first guide roll and the second guide roll, the first guide roll and the second guide roll being configured to rotate relative to the guide frame.

7. The door arrangement according to claim 6, wherein each of the first guide roll and the second guide roll is supported on the guide frame with a bolt that extends through a roller guide shoe, the bolt forming an axis of rotation of a corresponding one of the first guide roll and the second guide roll.

8. The door arrangement according to claim 6, further comprising:

a sliding guide part having a sliding guide surface at least one of in front of and behind one or more of the first guide roll and the second guide roll, the sliding guide part being an integral part of the guide frame.

9. The door arrangement according to claim 8, wherein a material of a guide surface of at least one of the first guide roll and the second guide roll is essentially harder than a material of at least one of the sliding guide part and the guide frame.

10. The door arrangement of claim 9, wherein the material of the at least one of the sliding guide part and the guide frame is high-density polyethylene (HDPE), and the material of the guide surface of the at least one of the first guide roll and the second guide roll is ultra-high-density polyethylene (UHDPE).

11. The door arrangement according to claim 1, further comprising:

a sliding guide part having a sliding guide surface at least one of in front of and behind one or more of the first guide roll and the second guide roll, the sliding guide part being an integral part of the guide frame; wherein a surface area of the sliding guide surface is configured to expand as the sliding guide part wears.

12. The door arrangement according to claim 1, wherein the guide rail is configured to support the at least one guide in at least one lateral direction via at least one of the first guide roll and the second guide roll, and wherein when the at least one of the first guide roll and the second guide roll wears, the support force provided to the at least one guide via at least one sliding guide surface in the lateral direction increases.

13. The door arrangement according to claim 12, wherein the at least one sliding guide surface is configured to move into contact with a guide surface of the guide rail only after the one or more of the first guide roll and the second guide roll has worn by a certain amount.

14. The door arrangement according to claim 1, wherein the at least one guide comprises:

a sliding guide surface of a sliding guide part at least one of in front of and behind each guide roll.

15. The elevator door arrangement of claim 1, wherein the sliding guide part further includes a second sliding guide surface, the second sliding guide surface being configured such that a surface area of the second sliding guide surface contacting the second guide surface increases as the second guide roll wears.

16. A guide of a door, the guide comprising:

a first guide roll contacting only a guide surface of a first side of the guide rail, the first guide roll being further configured to be supported by the guide surface of the first side of the guide rail;

a second guide roll contacting only a guide surface of a second side of the guide rail, the second guide roll being further configured to be supported by the guide surface of the second side of the guide rail; and a sliding guide part having a first sliding guide surface, the first sliding guide surface being configured such that a surface area of the first sliding guide surface contacting the guide surface of the first side of the guide rail increases as the first guide roll wears.

17. The guide according to claim 16, further comprising:

a plurality of sliding guide surfaces facing a first lateral direction; and a plurality of sliding guide surfaces facing a second lateral direction; wherein each of the sliding guide surfaces is an integral part of a guide frame supporting the first guide roll and the second guide roll.

* * * * *